US006803899B1

(12) United States Patent
Masazumi et al.

(10) Patent No.: US 6,803,899 B1
(45) Date of Patent: Oct. 12, 2004

(54) LIQUID CRYSTAL DISPLAY APPARATUS AND A TEMPERATURE COMPENSATION METHOD THEREFOR

(75) Inventors: Naoki Masazumi, Kobi (JP); Makiko Mandai, Takatsuki (JP); Katsuhiko Asai, Sakai (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/621,409

(22) Filed: Jul. 21, 2000

(30) Foreign Application Priority Data

Jul. 27, 1999 (JP) ..... 11-212348
Aug. 9, 1999 (JP) ..... 11-225177
Sep. 28, 1999 (JP) ..... 11-274594

(51) Int. Cl.[7] ..... G09G 3/36
(52) U.S. Cl. ..... 345/101; 345/103
(58) Field of Search ..... 345/101, 204, 345/94, 89, 690, 691, 699, 97, 87, 88, 103; 349/73, 35, 86

(56) References Cited

U.S. PATENT DOCUMENTS 5,608,422 A * 3/1997 Ikeda ..... 345/101
5,748,277 A 5/1998 Huang et al. ..... 349/169
5,774,105 A * 6/1998 Yamamoto et al. ..... 345/97
5,801,796 A * 9/1998 Lowe ..... 349/73
5,933,203 A 8/1999 Wu et al. ..... 349/35
6,037,920 A * 3/2000 Mizutome et al. ..... 345/87
6,052,103 A * 4/2000 Fujiwara et al. ..... 345/89
6,130,732 A * 10/2000 Crawford et al. ..... 349/86
6,232,938 B1 * 5/2001 Tsuchida et al. ..... 345/88
6,278,429 B1 * 8/2001 Ruth et al. ..... 345/94
6,320,571 B1 * 11/2001 Takahashi et al. ..... 345/204
6,377,321 B1 * 4/2002 Khan et al. ..... 349/35

* cited by examiner

*Primary Examiner*—Steven Saras
*Assistant Examiner*—Uchendu O. Anyaso
(74) *Attorney, Agent, or Firm*—Sidley Austin Brown & Wood LLP

(57) ABSTRACT

Disclosed is a liquid crystal display apparatus including a plurality of chiral nematic liquid crystal display layers stacked on each other. To compensate temperature dependency, a control unit, in accordance with a temperature detected by a temperature detection unit, adjusts at least one of a voltage level and a pulse width of a pulse signal be applied to at least one of the liquid crystal display. In one embodiment, the control unit retrieves the detected temperature before driving the liquid crystal display successively, and commonly uses the detected temperature for the successive drives. In another embodiment, the control unit does not adjust a voltage level nor a pulse width of a first reset pulse signal that is for setting the liquid crystal material to a homeotropic phase regardless of the detected temperature.

27 Claims, 15 Drawing Sheets

LIQUID CRYSTAL DISPLAY APPARATUS AND A TEMPERATURE COMPENSATION METHOD THEREFOR

CROSS REFERENCE TO RELATED APPLICATIONS

This application is based on Japanese Patent Application Nos. 11-212348, 11-225177, and 11-274594 filed in Japan on Jul. 27, 1999, Aug. 9, 1999, and Sep. 28, 1999, respectively, the entire content of which is hereby incorporated by reference.

BACKGROUND OF THE INVENTION

1. Field of the Invention

The present invention pertains to a liquid crystal display apparatus and its driving method, and more particularly, to a liquid crystal display apparatus equipped with a liquid crystal display using liquid crystal having a memory capability, and to the driving method for said apparatus.

2. Description of the Related Art

Using a conventionally known liquid crystal display in which a liquid crystal that exhibits a cholesteric phase at room temperature, such as a cholesteric liquid crystal or a chiral nematic liquid crystal, is sandwiched between two substrates, display may be performed by alternating the state of the liquid crystal between a planar state and a focal conic state.

In other words, when the liquid crystal is in a planar state, where the helical pitch is deemed (P) and the average refractive index is deemed (n), light having the wavelength $\lambda=P\cdot n$ is selectively reflected. Where the liquid crystal is in a focal conic state, when the selective reflection wavelength of the liquid crystal is in the infrared range, the liquid crystal scatters the light, and when the selective reflection wavelength is in the range shorter than the infrared range, the liquid crystal allows visible light to pass through. As a result, by setting the selective reflection wavelength to be in the visible range, and by locating a light-absorbing layer on the side of the element opposite the side that is observed, display of the selectively reflected color may be obtained when the display is in the planar state, while black is displayed when the display is in the focal conic state.

Where the selective reflection wavelength is set to be within the infrared range and the light-absorbing layer is located on the side of the element opposite the side that is observed, a black display is obtained because light having a wavelength within the infrared range is reflected but light in the visible range passes through when the liquid crystal is in the planer state. Consequently, a white display can be obtained through scattering of the light when the display is in the focal conic state.

By using three stacked elements set to selectively reflect red, green and blue, respectively, a color display may be obtained.

This type of liquid crystal display may be alternated between a planar state and a focal conic state through the application of voltage. If the threshold voltage required to eliminate the twist in the liquid crystal is deemed Vth1, when Vth1 is applied for a sufficient amount of time, and then the voltage is reduced to a lower voltage Vth2, the display enters a planar state. When a voltage between Vth2 and Vth1 is applied for a sufficient amount of time, the display enters a focal conic state. These two states remain stable even after the application of voltage is stopped. It is also known that these two states may coexist, enabling halftone display.

Incidentally, the display state of the liquid crystal generally depends on the ambient temperature. Chiral nematic liquid crystal in particular has a temperature characteristic in which the display state (the Y value, i.e., the luminous reflectance) changes in accordance with the surrounding temperature. This is caused mainly by the fact that the viscosity of the chiral nematic liquid crystal falls as its temperature rises. Therefore, when the display is driven by means of a pulse voltage having a constant voltage level and pulse width at all times, chiral nematic liquid crystal entails the problem that its display state changes depending on the temperature.

With ordinary nematic liquid crystal, the drive voltage must be continuously applied to maintain the display, and real-time ambient temperature information from a temperature detection unit must be incorporated as a drive condition. However, the incorporation of this real-time temperature information imposed a substantial burden on the control unit (i.e., the CPU), and entails high power consumption. On the other hand, when the liquid crystal used has a memory capability that can maintain a display even if the application of drive voltage is stopped—such as cholesteric liquid crystal or chiral nematic liquid crystal—the proper timing and frequency of the incorporation of the temperature information have not yet been determined.

In addition, chiral nematic crystal is known to have a unique hysterisis phenomenon. Therefore, in order to avoid the occurrence of problems arising due to this hysterisis phenomenon, when performing driving, it is desired that the desired pixels be set to the desired state after a first reset pulse signal is applied to the liquid crystal and that the liquid crystal be reset to the homeotropic state. However, because the reset pulse signal to reset the liquid crystal to the homeotropic state as described above requires more energy than the selection pulse signal used to set the liquid crystal to the desired reflection state, multiple pulse signals that entail different amounts of energy are normally required to drive chiral nematic liquid crystal. Therefore, temperature compensation must be performed for each of these pulse signals, and the problem arises that the driving method and drive circuit become more complex.

SUMMARY OF THE INVENTION

Therefore, the object of the present invention is to provide a layered liquid crystal display apparatus that can avoid display state variation regardless of changes in the surrounding temperature.

Another object of the present invention is to provide a liquid crystal display apparatus and associated driving method in which good display can always be performed regardless of changes in the surrounding temperature and in which the driving method and drive circuit are simplified.

Yet another object of the present invention is to provide a liquid crystal display apparatus and associated driving method that reduce the burden on the control unit and efficiently incorporate temperature information while reducing power consumption.

In order to attain these and other objects, the liquid crystal display apparatus reflecting a first aspect of the present invention comprises: a liquid crystal display including a liquid crystal material having a memory capability; a temperature detection unit that detects a temperature of the liquid crystal display or a temperature of the environment surrounding the liquid crystal display; and a control unit connected with the liquid crystal display and the temperature detection unit, the control unit applying drive pulse signals to the liquid crystal display to draw a first image on the liquid crystal display and leaving the liquid crystal without applying a drive pulse signal to maintain the first image by using the memory capability of the liquid crystal, wherein the control unit incorporates temperature information from the temperature detection unit before the drawing of the first image.

The liquid crystal display apparatus described above may also include (i) a first display mode under which the control unit applies the drive pulse signals to the liquid crystal display to draw the first image on the liquid crystal display and leaving the liquid crystal without applying a drive pulse signal to maintain the image by using the memory capability of the liquid crystal; and (ii) a second display mode under which the control unit successively draws a second image to an n-th image data on the liquid crystal display. In this case, when the first display mode is active, the control unit incorporates temperature information from the temperature detection unit before the drawing of the first image, while when the second display mode is active, the temperature information is incorporated by the control unit before the drawing of the second image, and thus incorporated temperature information is commonly used for the drawings of the second image to the n-th image.

In other words, because the temperature information need not be continuously incorporated in the liquid crystal display apparatus described above, power consumption may be reduced by putting the CPU to sleep during periods when redrawing is not being performed, or by putting to sleep all components of the CPU other than those which are necessary to detect instructions to redraw the display.

The liquid crystal display apparatus reflecting a second aspect of the present invention comprises: a liquid crystal display including a liquid crystal material having a memory capability; a temperature detection unit that detects a temperature of the liquid crystal display or a temperature of an environment surrounding the liquid crystal display; and a control unit connected with the liquid crystal display and the temperature detection unit, the control unit applying a first reset pulse signal to the liquid crystal display, the first reset pulse signal being for setting the liquid crystal to a homeotropic state before the liquid crystal is set to the desired selective reflection state, wherein the control unit keeps a voltage level and a pulse width of the first reset pulse signal constant regardless of the temperature detected by the temperature detection unit.

In other words, if the first reset pulse signal is set to a certain fixed pulse width and voltage level, the liquid crystal may be set to the homeotropic state. Therefore, by keeping the pulse width and voltage level of the first reset pulse signal fixed regardless of changes in the temperature, the driving method and the drive circuit may be simplified.

In the liquid crystal display apparatus described above, a selection pulse signal that sets an area of the liquid crystal to a desired state may be applied to drive the crystal after the first reset pulse signal is applied, and then at least one of a voltage level and a pulse width of the selection pulse signal may be changed in accordance with the detected temperature. In other words, because the selection pulse signal has a temperature dependence unique to the liquid crystal, by changing at least one of the voltage level and the pulse width of the selection pulse signal in accordance with changes in temperature, a stable, high-quality display may be obtained.

In the liquid crystal display apparatus described above, where the selection pulse signals are applied after the application of a second reset pulse signal that follows the first reset pulse signal and sets the liquid crystal to the focal conic state, it is acceptable if at least one of a voltage level and a pulse width of the second reset pulse signal is changed in accordance with the temperature detected by the temperature detection unit, or if the voltage level and pulse width are kept constant regardless of the temperature detected by the temperature detection unit.

In other words, the temperature dependence of the second reset pulse signal varies depending on the type of liquid crystal. If the temperature dependence can be ignored when a specific pulse width and voltage level are set, the pulse width and voltage level should be kept constant regardless of changes in the temperature. However, where the liquid crystal exhibits marked temperature dependence, the pulse width and voltage level should vary in response to changes in temperature.

By employing the structure described above, the problems of (i) variation in the reset state of the liquid crystal due to changes in temperature, and (ii) fluctuating display states, may be prevented from occurring, and a stable, high-quality display may be obtained at all times.

The liquid crystal display apparatus reflecting a third aspect of the present invention comprises: a liquid crystal display comprising a plurality of liquid crystal display layers stacked each other; a drive unit connected with the liquid crystal display, the drive unit applying a pulse voltage to each of the liquid crystal display layers to drive the liquid crystal display layers; a temperature detection unit that detects a temperature of the liquid crystal display or a temperature of an environment surrounding the liquid crystal display; and a controller connected with the drive unit and the temperature detection unit, the controller performs a temperature compensation by adjusting at least one of a voltage level and a pulse width of the pulse signal applied from the drive unit to at least one of the liquid crystal display layers based on the temperature detected by the temperature detection unit.

The temperature characteristic of a specific liquid crystal, i.e., the change in the display state (Y value) of the liquid crystal in response to changes in temperature, based on such a parameter as the voltage level and/or the pulse width of the drive pulse voltage, may be predicted beforehand. As a result, by detecting the temperature of the liquid crystal display or the surrounding temperature, temperature compensation in which the drive pulse voltage is adjusted is performed in the present invention. In this way, a fixed display state may be continuously maintained regardless of changes in the ambient temperature.

The controller may perform temperature compensation for all the liquid crystal display layers, or only for specific layers. When temperature compensation is performed for all layers, more precise temperature compensation must be performed, while control is easier to perform when temperature compensation is carried out for only specified layers.

The controller may have separate temperature compensation data for each display layer, or may use common temperature compensation data for all layers. In the former case, more precise temperature compensation must be performed, while in the latter case, the control process is simpler.

In each of the liquid crystal display apparatuses reflecting the first to third aspects of the invention, the temperature detection unit may have multiple sensors, so that the temperature of the liquid crystal display or the temperature surrounding the liquid crystal display is detected by these multiple sensors, and the temperature information from these sensors is reflected in the subsequent temperature compensation. In this case, the multiple sensors may be located at both the observation side and at the back of the liquid crystal display, and may be located at multiple locations in the same plane as the screen of the liquid crystal display.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENTS

Embodiments of the liquid crystal display apparatus and associated display method pertaining to the present invention will be explained below with reference to the attached drawings.

First Embodiment (Construction of Liquid Crystal Display)

Figure 1:
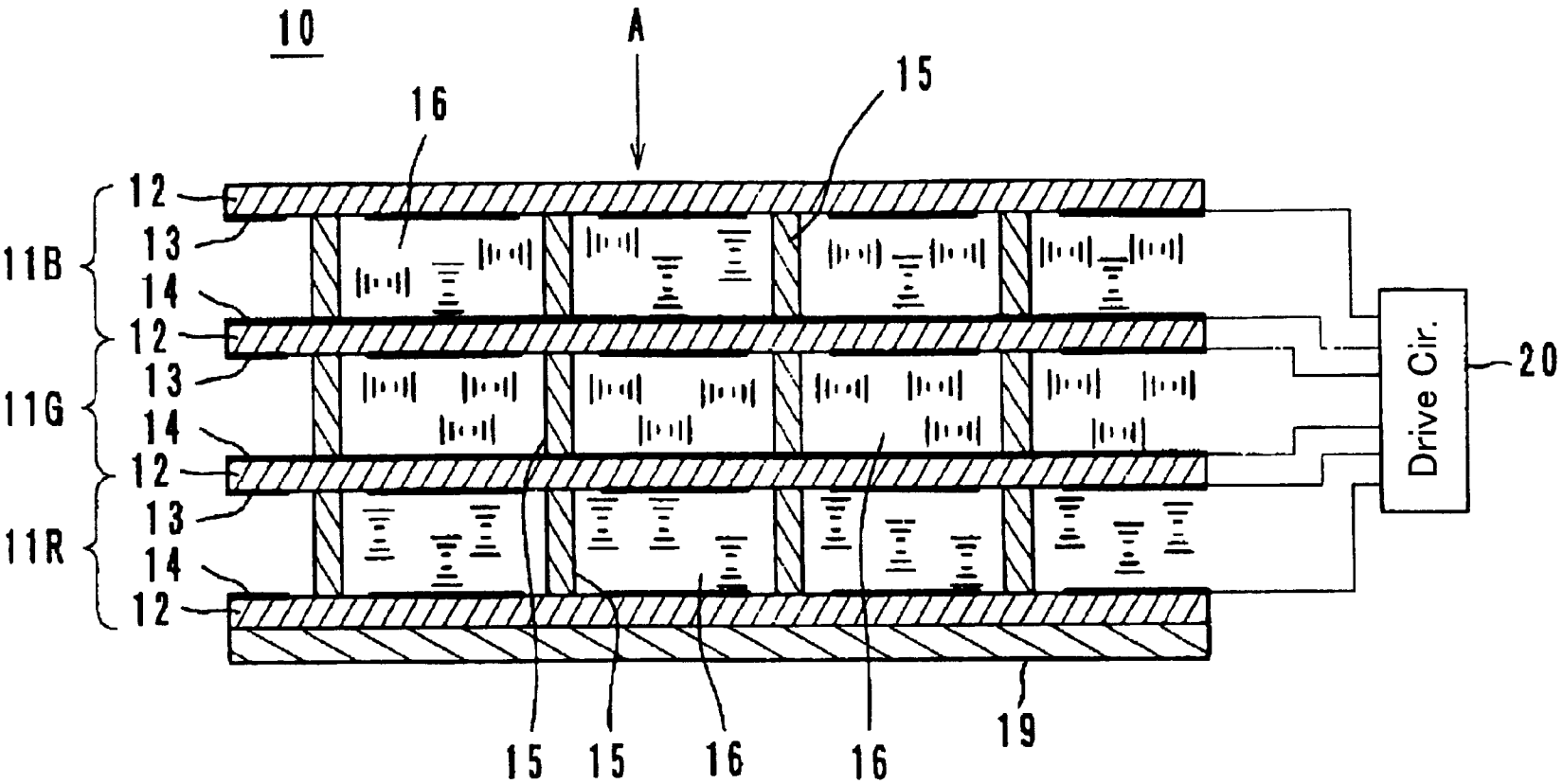
FIG. 1 is a cross-sectional view showing one example of a liquid crystal display comprising the liquid crystal display apparatus pertaining to the present invention.

First, an example of the reflective liquid crystal display comprising the liquid crystal display apparatus of the present invention is shown in FIG. 1. This liquid crystal display 10 has a red display layer 11R that performs display by alternating between a red selective reflection state and a transparent state located above a light absorbing layer 19, a green display layer 11G that performs display by alternating between a green selective reflection state and a transparent state stacked on top of the red display layer 11R, and a blue display layer 11B that performs display by alternating between a blue selective reflection state and a transparent state stacked on top of the green display layer 11G.

Each display layer 11R, 11G and 11B comprises a pair of transparent substrates 12 on which are formed transparent electrodes 13 and 14, and between which are sandwiched cylindrical resin structures 15, thickness-regulating spacers not shown in the drawing, and liquid crystal material 16 that performs selective-reflection display of its respective color. In addition, it is also acceptable if an orientation control film or insulating film not shown in the drawing is formed on top of the transparent electrodes 13 and 14, or if particles serving as spacer particles are dispersed on the electrodes.

For the liquid crystal material 16, either cholesteric liquid crystal material exhibiting a cholesteric phase or chiral nematic liquid crystal material may be used. Chiral nematic liquid crystal material is obtained by adding a chiral agent to nematic liquid crystal composition or compound. When added to nematic liquid crystal composition or compound, a chiral agent has the effect of twisting the molecular alignment of the nematic liquid crystal composition or compound, and the selective reflection wavelength of the liquid crystal is controlled by adjusting the amount of chiral agent added.

In this liquid crystal display 10, the transparent electrodes 13 and 14 of each display layer 11R, 11G and 11B are connected to the drive circuit 20, and a prescribed pulse voltage is applied by the drive circuit 20 between the transparent electrodes 13 and 14. In response to this applied voltage, the display of each liquid crystal 16 is alternated between a transparent state (focal conic state) in which visible light passes through and a selective reflection state (planar state) in which visible light is selectively reflected.

The transparent electrodes 13 and 14 each comprise multiple parallel belt-shaped electrodes with a minute gap in between them, and the direction of alignment of the electrodes 13 is perpendicular to the direction of alignment of the electrodes 14, while they are made to face each other. In other words, display is performed through the serial application of voltage to each liquid crystal 16 in a matrix fashion. By carrying out this matrix driving serially or simultaneously for each color display layer 11R, 11G and 11B, multi-color images are displayed on the liquid crystal display 10.

When a light-absorbing layer 19 is placed on the bottom-most layer, i.e, the layer farthest from the observer (the direction of arrow A), the light passing through each display layer 11R, 11G and 11B is completely absorbed by the light-absorbing layer 19. In other words, if all of the display layers are in the transparent state, black is displayed. For the light-absorbing layer 19, black film may be used, for example. It is also acceptable if the light-absorbing layer 19 is achieved by applying a black paint, such as black ink, to the bottom surface of the display 10.

In FIG. 1, the state is shown in which the red display layer 11R is in the planar state, the green display layer 11G is in the focal conic state, and the blue display layer 11B is in a mixed state in which both the planar and the focal conic states coexist. The display layers 11R, 11G and 11B in the liquid crystal display 10 may also be stacked in an order different from that shown in FIG. 1.

(Driving Method)

Figure 2:
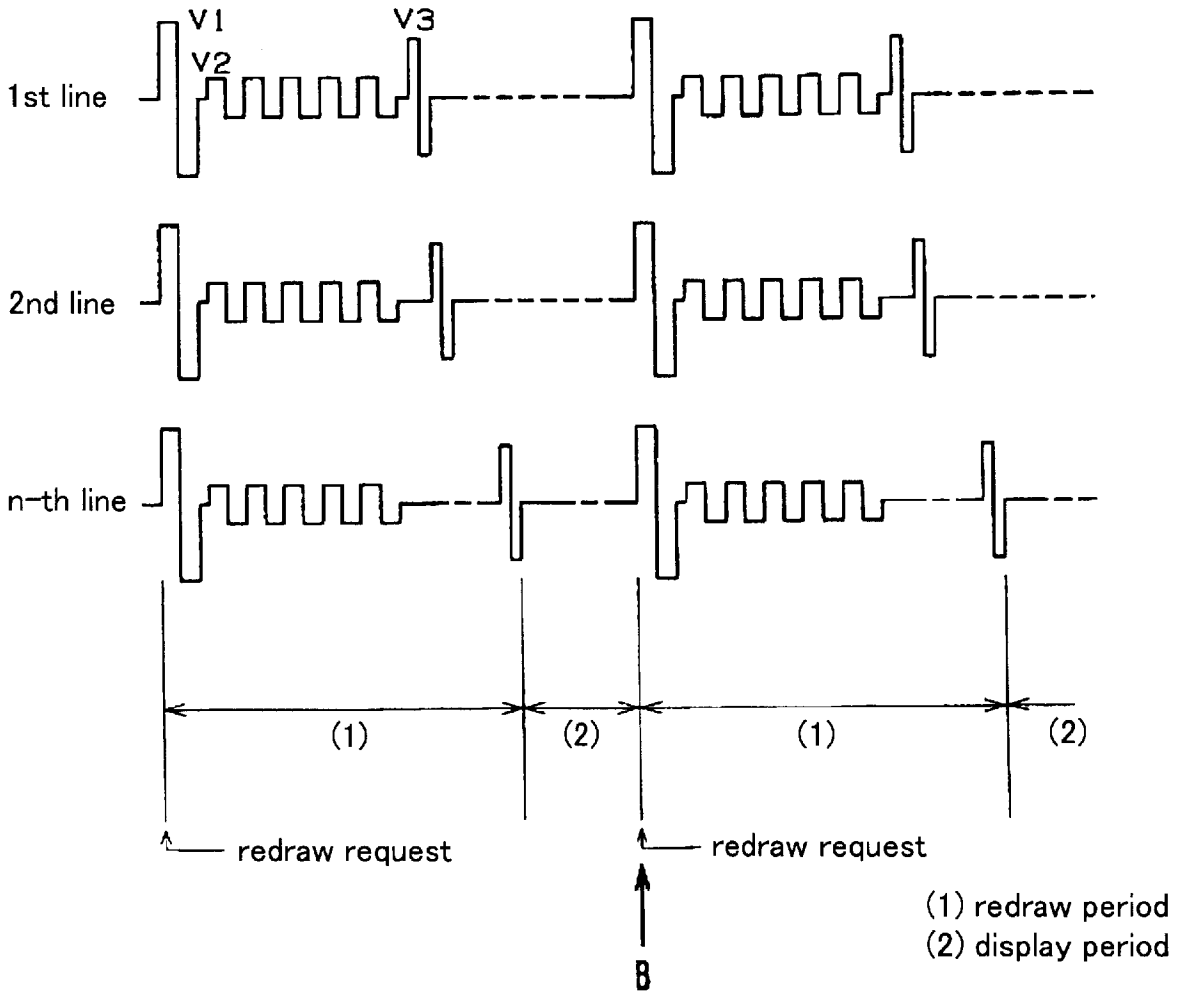
FIG. 2 is a chart showing the voltage waveform for a first drive configuration pertaining to the present invention.

There are many methods for driving the liquid crystal display apparatus of the present invention, such as the focal conic reset method, the phase transition driving method and the dynamic drive method. An example of the waveform of the voltage applied to the liquid crystal where driving is performed using the focal conic reset method is shown in FIG. 2. Here, a time band over which voltage is applied to any scanning lines of the display layer is called a redraw period, and the time band between a redraw period and a subsequent redraw period is called a display period.

In a redraw period, first, the twist structure of the liquid crystal material is cleared through the application of a first reset pulse having a voltage level V1, causing the liquid crystal material to enter a homeotropic state. The liquid crystal material is then caused to enter a focal conic state through the application of a second reset pulse having a voltage level V2. A selection pulse having a voltage level V3 is then applied to the pixels that are to perform display. The voltage level and width of this pulse determines the display state of the liquid crystal material.

Figure 3:
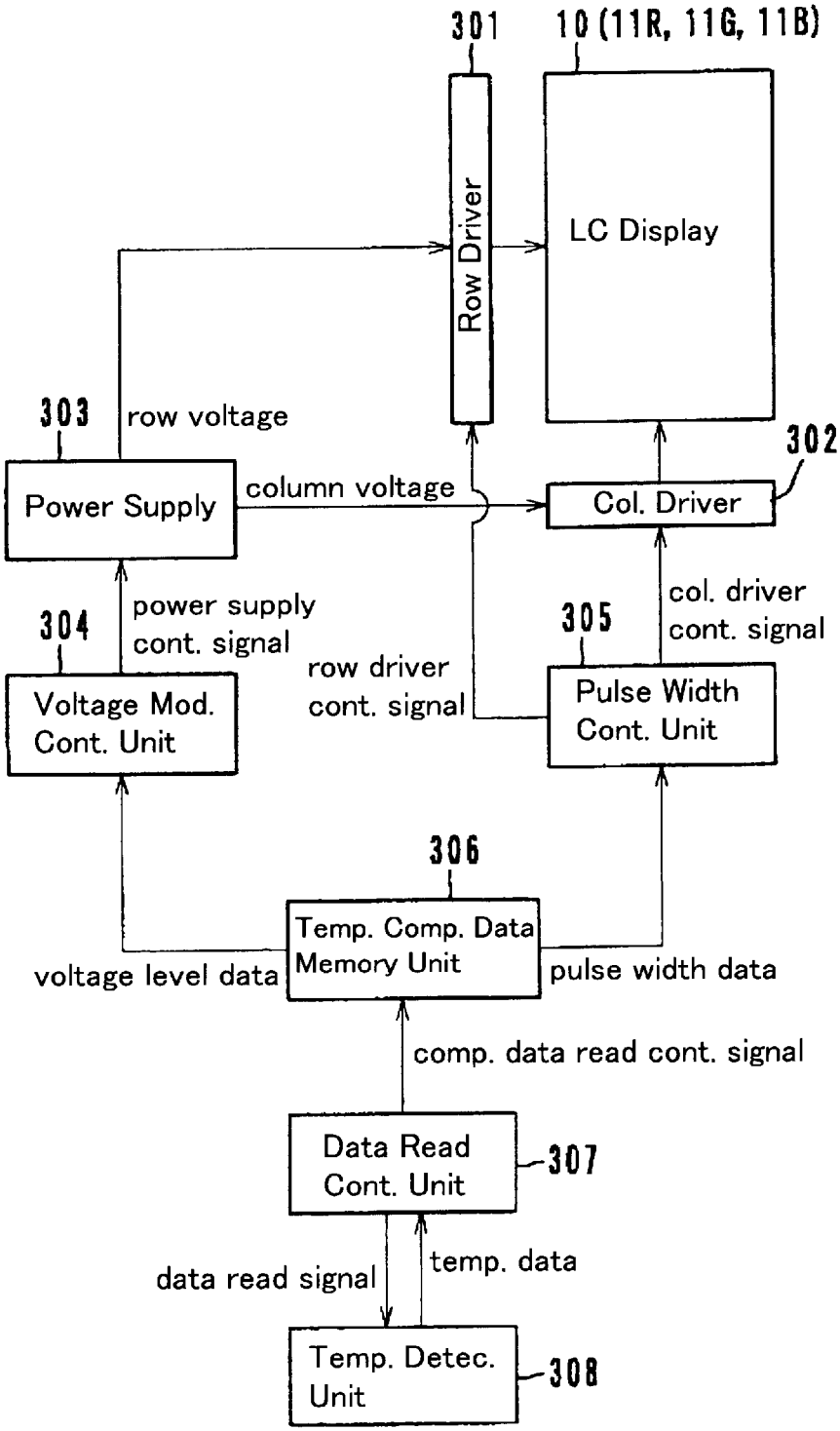
FIG. 3 is a block diagram showing the temperature compensation control unit of the liquid crystal display apparatus pertaining to the present invention.

The control unit that performs temperature compensation in the liquid crystal display apparatus pertaining to the present invention is shown in FIG. 3. The temperature detection unit 308 includes temperature sensors and detects the ambient temperature. When a data read signal is output from the data read control unit 307 to the temperature detection unit 308 in accordance with the timing sequence indicated by arrow B in FIG. 2 before the redraw period, the temperature detection unit 308 outputs temperature data to the data read control unit 307. The data read control unit 307 outputs to the temperature compensation data memory unit 306 a data read control signal for the temperature compensation data corresponding to the temperature data.

Based on the compensation data read control signal output from the data read control unit 307, the temperature compensation data memory unit 306 refers to the compensation data stored in memory. It then outputs voltage level data to the voltage modulation control unit 304 and outputs pulse width data to the pulse width control unit 305. The voltage modulation control unit 304 outputs a power supply control signal to the power supply 303 based on the received voltage level data. In response to the power supply control signal, the power supply 303 outputs row voltage to the row driver 301 and outputs column voltage to the column driver 302. The pulse width control unit 305 controls the row driver 301 and the column driver 302 based on the received pulse width data. Through this control, pulses having the desired voltage level and pulse width can be applied to the liquid crystal display 10.

Figure 4:
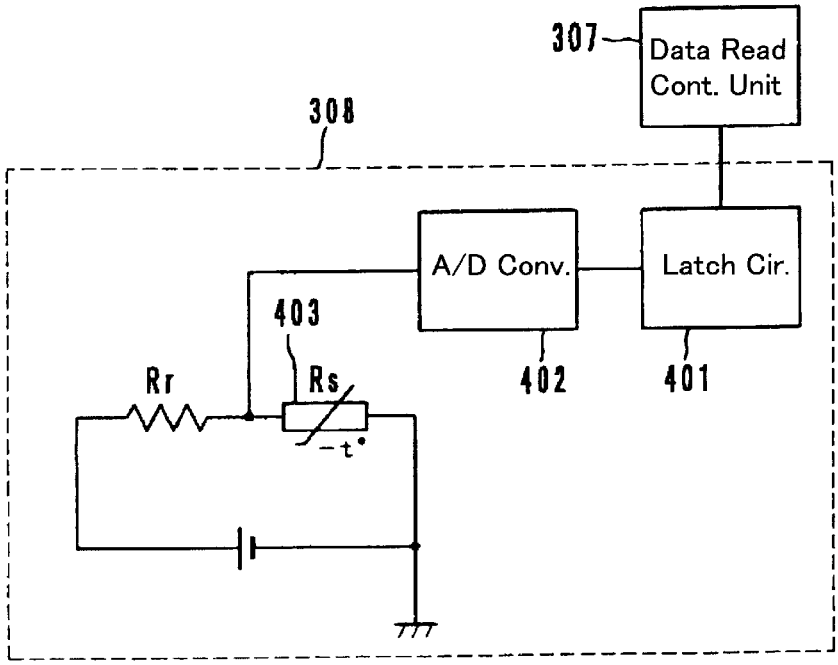
FIG. 4 is a block diagram showing one example of a temperature detection circuit.

The temperature detection unit 308 may comprise, for example, a temperature detection circuit using a thermistor as a sensor. FIG. 4 shows one example of such a temperature detection unit. Voltage is continuously applied to the thermistor 403, and temperature data is output by the A/D converter 402. When a temperature data read control signal is output from the data read control unit 307, the temperature data is latched by the latch circuit 401, and the latched temperature data is received by the data read control unit 307.

Figure 5:
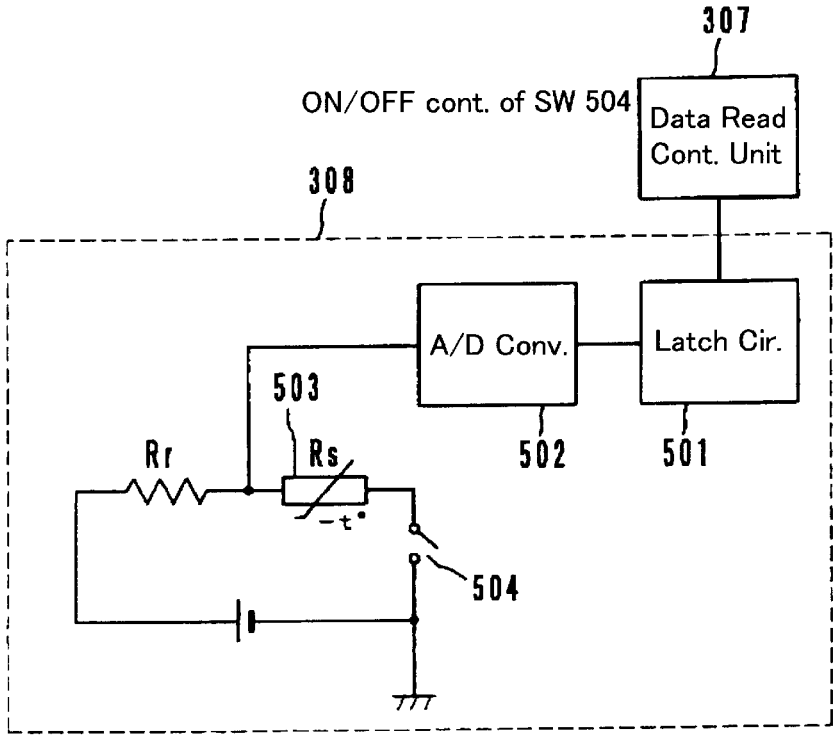
FIG. 5 is a block diagram showing another example of a temperature detection circuit.

Another example of a temperature detection circuit using a thermistor is shown in FIG. 5. Normally, the power supply circuit is kept open by the switch 504, such that voltage is not applied to the thermistor 503. When a temperature data read control signal is output by the data read control unit 307, the switch 504 becomes ON, voltage is applied to the thermistor 503, voltage corresponding to the thermistor 503 is output via the A/D converter 502 as temperature data, and this temperature data is latched by the latch circuit 501, whereupon the latched temperature data is received by the data read control unit 307.

Second Embodiment

Because chiral nematic liquid crystal responds slowly to the application of voltage, its screen redraw speed is much slower than that for ordinary nematic liquid crystal. Consequently, in order to perform sequential screen redraw in a manner resembling the flipping of the pages of a book, the liquid crystal display apparatus pertaining to a second embodiment of the present invention is equipped with a fast display mode that adjusts the resolution and contrast in order to increase the speed of screen redraw.

Figure 6:
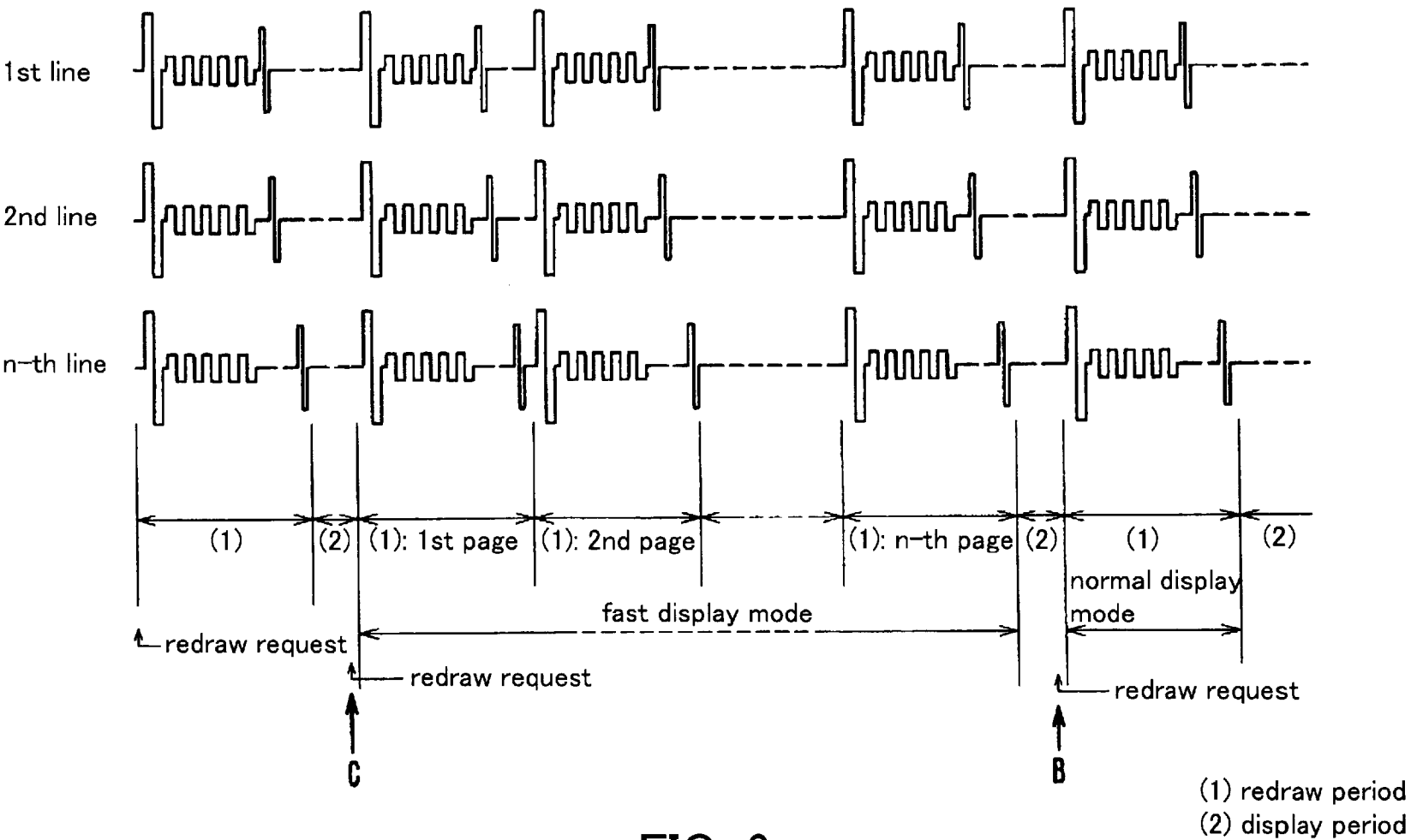
FIG. 6 is a chart showing the voltage waveform for a second drive configuration pertaining to the present invention.

In the second embodiment, the control unit used for temperature compensation is identical to the control unit shown in FIG. 3, and the voltage waveform to perform driving is shown in FIG. 6.

Where redraw is performed in normal mode, the temperature data is received in accordance with the timing indicated by the arrow B in FIG. 2 in connection with the first embodiment, after the redraw instruction is issued but before the redraw period is entered, (this timing is also indicated by the arrow B in FIG. 6).

On the other hand, where redraw is performed in fast display mode, the screen is redrawn without the receipt of temperature data between the time that temperature data is received before the redraw period for the first page (see the arrow C in FIG. 6) and the time that fast display mode is terminated.

Third Embodiment

In the third embodiment, the control unit used for temperature compensation is identical to the control unit shown in FIG. 3, and the voltage waveform to perform driving is shown in FIG. 6.

Figure 7:
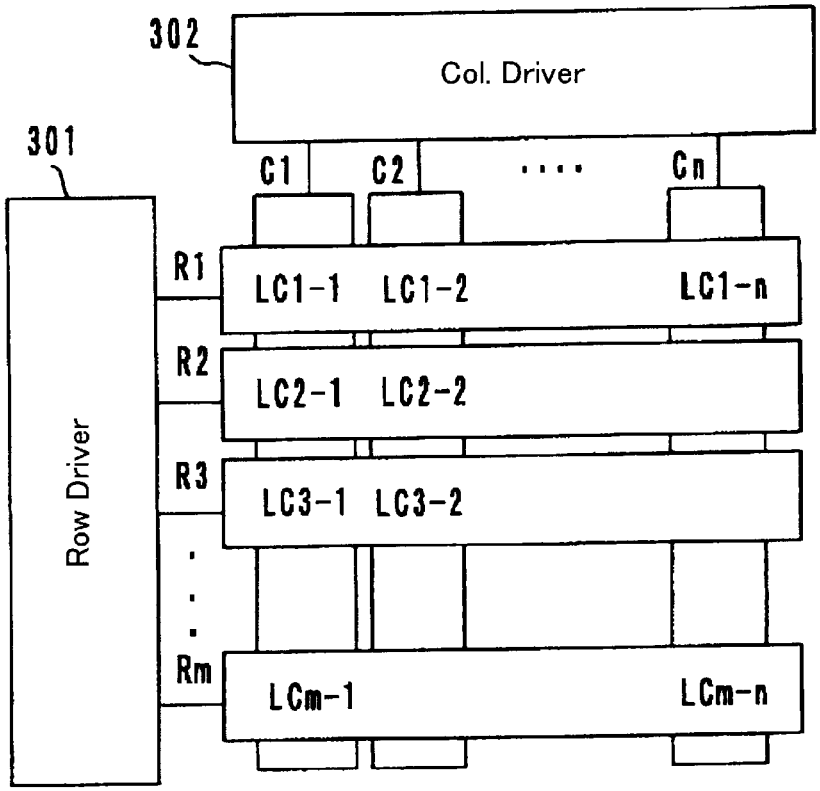
FIG. 7 is a block diagram showing the matrix drive circuit for the liquid crystal display.

Because the pixels in each layer of the liquid crystal display 10 have a simple matrix structure, it can be expressed as an (m×n) matrix incorporating the scanning electrodes R1, R2 . . . Rm and the signal electrodes C1, C2 . . . Cn, as shown in FIG. 7. The pixel at which a scanning electrode Ra and a signal electrode Cb intersect (where (a) and (b) satisfy the conditions a <m and b<n, respectively) are deemed LCa-b. These groups of electrodes are connected to the output terminals of the row driver 301 and the column driver 302, and a scanning voltage and selection voltage are applied to each electrode from the row driver 301 and the column driver 302. Incidentally, the applied voltages explained below (reset pulse signal, selection pulse signal) refer to the voltage level comprising the scanning voltage superimposed on the selection voltage.

(Driving Method)

As the method for driving each liquid crystal display layer in the liquid crystal display 10, the temperature dependence of the drive signal and its corresponding driving method will be explained, using the example of the driving method in which each liquid crystal layer is first reset to the focal conic state.

Figure 8:
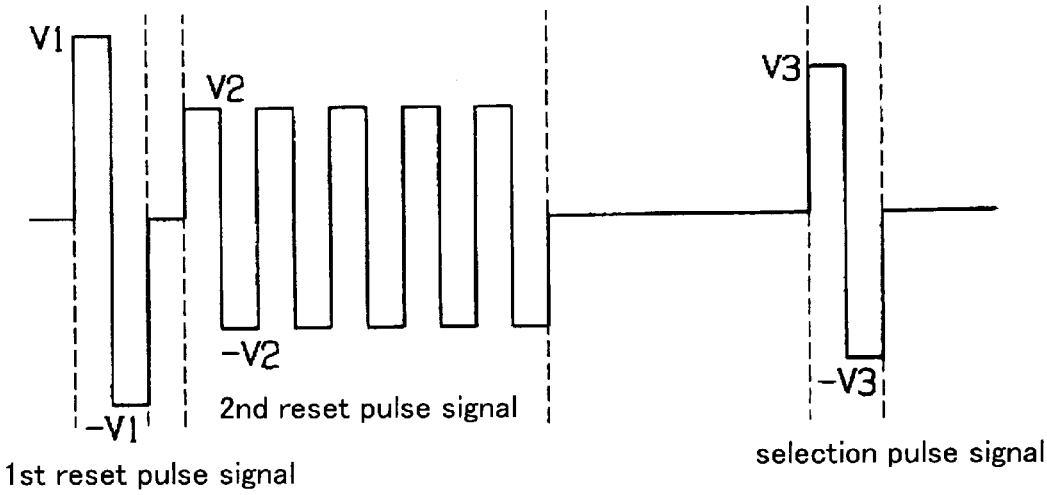
FIG. 8 is a chart showing the pulse voltage waveform for the driving of liquid crystal.

FIG. 8 shows the waveform of the voltage applied to the liquid crystal when the liquid crystal is reset to the focal conic state and the desired display is performed. First, a first reset pulse signal having a voltage level V1 is applied. The twist structure of the chiral nematic liquid crystal material is cleared through the application of this pulse signal, and the liquid crystal material enters a homeotropic state. A second reset pulse signal having a voltage level V2 is then applied. This pulse signal changes the chiral nematic liquid crystal material to a focal conic state.

If the reset periods for the application of the first and second reset pulse signals are set simultaneously for all pixels, and the selection pulse signals are applied sequentially to the pixels in each scanning line to redraw the screen, a good screen display that does not exhibit the hysterisis phenomenon may be attained in a short amount of time.

A selection pulse signal is then applied to the pixels that are to perform display. The display state of the chiral nematic liquid crystal is determined based on the voltage level and pulse width of this pulse signal. Here, a voltage V3 comprising the minimum voltage necessary to set the chiral nematic liquid crystal to a planar state (the brightest state) is used.

Figure 9:
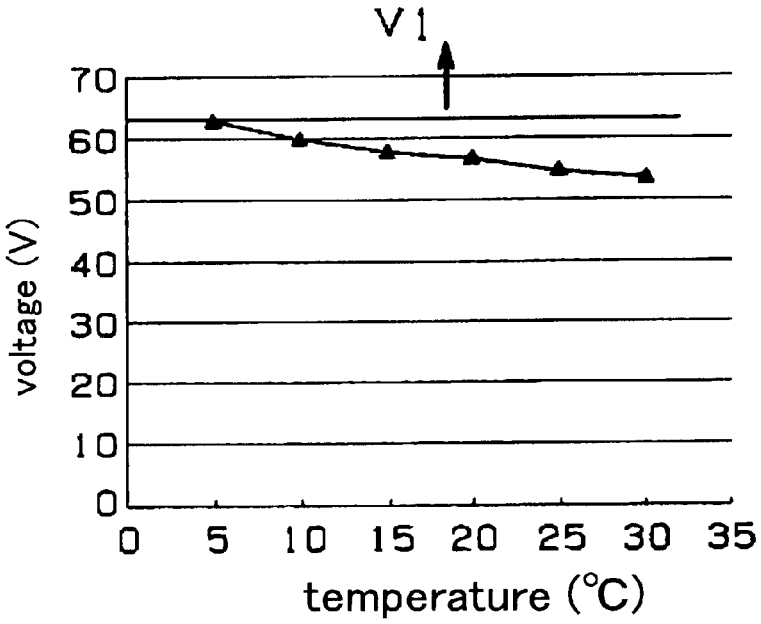
FIG. 9 is a graph showing one example of the temperature dependence of the first reset pulse signal.

An example of the temperature dependence of the first reset pulse signal is shown in FIG. 9. This represents the value obtained when a pulse having a pulse width of 3 msec was applied to a liquid crystal display using chiral nematic liquid crystal material comprising E44 nematic liquid crystal composition to which S811 chiral agent (both available from Merck & Co.) was added such that the selective reflection wavelength would be 550 nm.

In FIG. 9, the horizontal axis represents the temperature and the vertical axis represents the voltage level. As the temperature rises, the voltage level falls. However, because the first reset pulse signal should be set to the voltage level sufficiently high to change the liquid crystal to a homeotropic state, if it is set to at least the highest voltage level shown in FIG. 5 (approximately 63V), there is no need to change the voltage even if the temperature changes.

Figure 10:
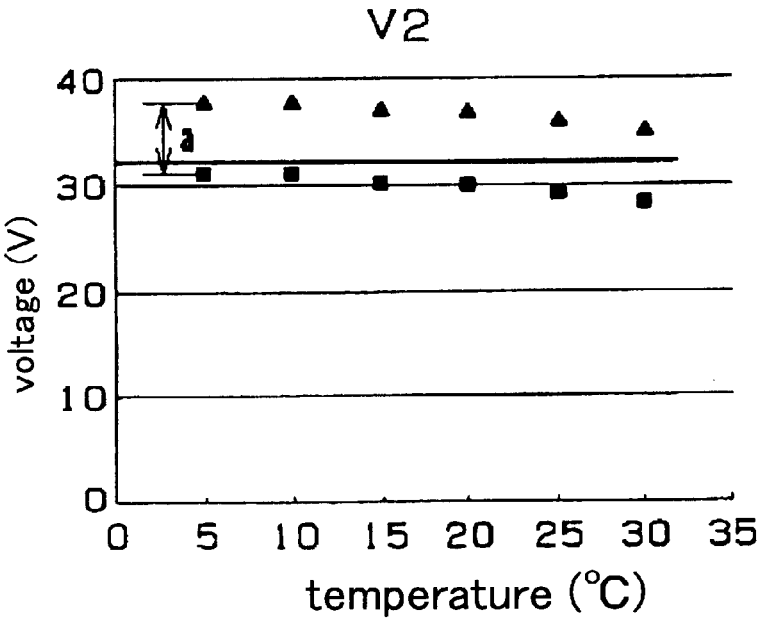
FIG. 10 is a graph showing one example of the temperature dependence of the second reset pulse signal.

An example of the temperature dependence of the second reset pulse signal is shown in FIG. 10. Again, the horizontal axis represents the temperature and the vertical axis represents the voltage level. The second reset pulse signal that is for setting the liquid crystal material to the focal conic state has a voltage level range of a width (a). The black triangular mark indicates the maximum voltage level for that temperature, and the black square mark represents the lowest voltage level for that temperature. Based on the temperature dependence shown in FIG. 10, a voltage level of approximately 32V, for example, may be generally used in the normally present temperature range.

Figure 11:
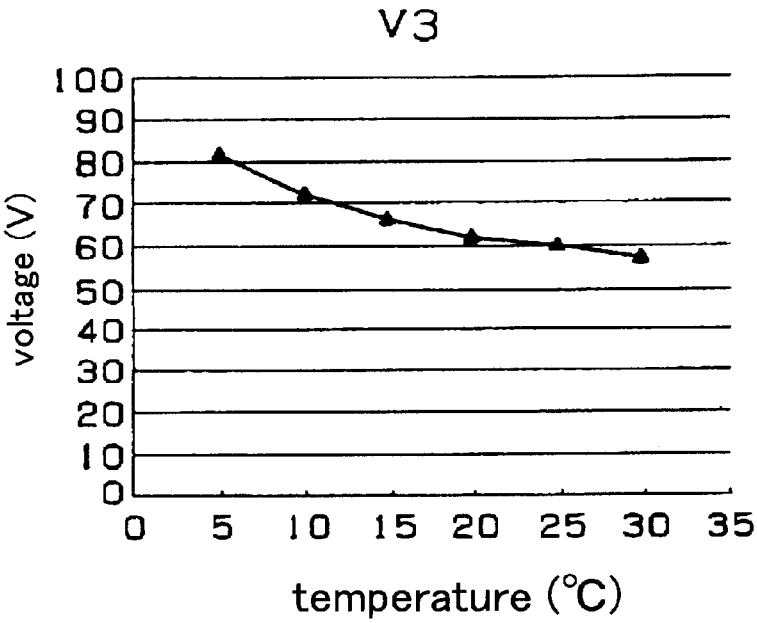
FIG. 11 is a graph showing one example of the temperature dependence of the selection pulse signal.

An example of the temperature dependence of the selection pulse signal is shown in FIG. 11. The horizontal axis represents the temperature, the vertical axis represents the voltage level, and the minimum voltage level necessary to obtain the planar state (the brightest state) is plotted. As the temperature rises, the voltage level of the selection pulse signal falls. Because the display state is determined by this voltage level, if the temperature is detected and the voltage level corrected, consistent display may be performed even if the temperature changes.

In this third embodiment, therefore, when the liquid crystal material is driven, the voltages for the first and second reset pulse signals are kept at a fixed level, and the voltage level for the selection pulse signal is changed in response to the temperature (see FIG. 11). The pulse width for each pulse signal is kept constant regardless of the temperature.

In this way, because the voltage levels and the pulse widths for both the first and second reset pulse signals are kept constant regardless of the temperature, driving control is easy and the circuit construction is simplified.

Fourth Embodiment

The second reset pulse signal has a voltage level range having a width (a) (see FIG. 10), and depending on the type of chiral nematic crystal used, i.e., when the liquid crystal exhibits a large temperature variability, in some cases it is preferable to change the voltage level V2 of the second reset pulse signal depending on the temperature.

In this case, the first reset pulse signal may be kept constant regardless of the temperature if the voltage level equals or exceeds a prescribed level, as in the first embodiment discussed above. In addition, the voltage level of the selection pulse signal is changed in accordance with the temperature, as in the first embodiment.

Therefore, in this fourth embodiment, when the liquid crystal material is driven, the first reset pulse signal is kept at a constant voltage level, and the voltage levels of the second reset pulse signal and the selection pulse signal are changed in accordance with the temperature. For each pulse signal, the pulse width is kept constant regardless of the temperature.

Fifth Embodiment

Figure 12:
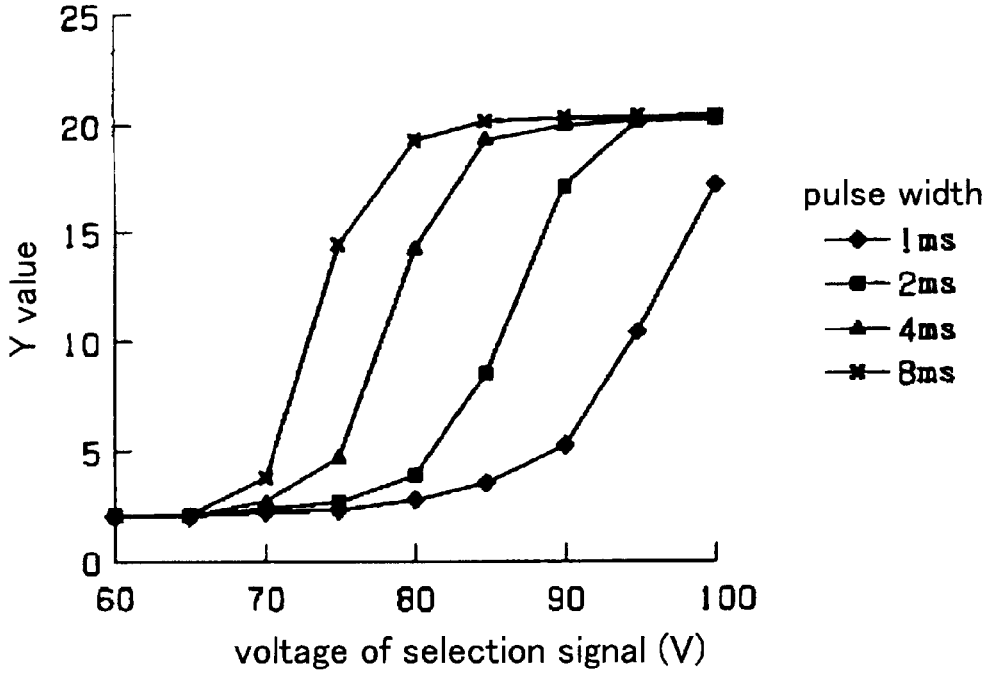
FIG. 12 is a graph showing various pulse widths in regard to the V-Y characteristic of the selection pulse signal.

The molecular alignment of chiral nematic liquid crystal material may also be selected by changing the pulse width of the selection pulse signal applied to the liquid crystal. An example in which the relationship between the voltage level V of the applied selection pulse signal and the selected Y value (luminous reflectance) (hereinafter termed the 'V-Y characteristic') was measured for various pulse widths is shown in FIG. 12.

It is seen that for any given pulse width, the molecular alignment of the liquid crystal can be selected by adjusting the voltage level of the selection pulse signal. It is also seen that the V-Y characteristic changes depending on the pulse width of the selection pulse signal. In other words, as the pulse width increases, the voltage level needed to select the same Y value decreases, and conversely, as the pulse width decreases, the voltage level needed to select the same Y value increases.

Similarly, regarding the first and second reset pulse signals as well, it is seen that as the pulse width increases, the required voltage level decreases. Therefore, it is acceptable if the voltage levels for the selection pulse signal and the second reset pulse signal if necessary are kept constant, while their pulse width is changed in response to changes in the ambient temperature. In other words, it is preferable to carry out temperature compensation such that where the temperature is low, these pulse signals have a large pulse width, and where the temperature is high, the pulse signals have a small pulse width. Naturally, in this case as well, the voltage level and pulse width of the first reset pulse signal are kept constant.

It is also acceptable if the voltage levels and the pulse widths of the selection pulse signal and the second reset pulse signal if necessaries are changed in response to changes in the ambient temperature.

Sixth Embodiment

Figure 13:
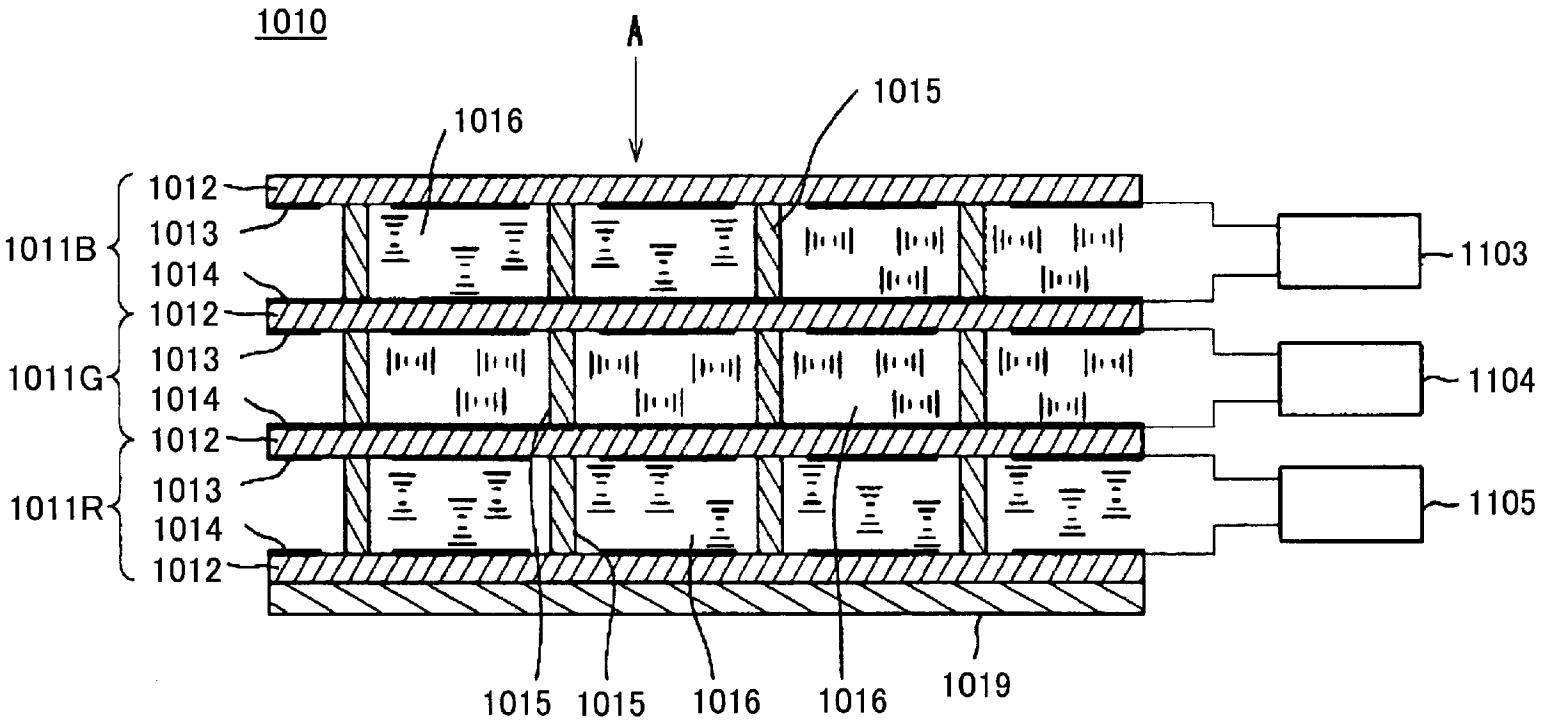
FIG. 13 is a cross-sectional view showing one example of a display comprising the liquid crystal display apparatus of a sixth embodiment of the present invention.

First, an example of the liquid crystal display comprising the liquid crystal display apparatus of this embodiment is shown in FIG. 13. The liquid crystal display apparatus comprises a liquid crystal display 1010, drive circuits 1103, 1104 and 1105, and a temperature detection circuit 1106 (see FIG. 16).

The liquid crystal display 1010 comprises a red display layer 1011R that performs display by alternating between selective reflection of red and a transparent state, a green display layer 1011G that performs display by alternating between selective reflection of green and a transparent state, and a blue display layer 1011B that performs display by alternating between selective reflection of blue and a transparent state, stacked one on top of another with a light-absorbing layer 1019 as the bottom layer.

Each liquid crystal display layer 1101B, 1011G and 1011R comprises cylindrical resin structures 1015 and liquid crystal material 1016 sandwiched between transparent substrates 1012 on which transparent electrodes 1013 and 1014 are formed, respectively. In addition, it is also acceptable if an orientation control film or insulating film not shown in the drawing is formed on top of the transparent electrodes 13 and 14, or if particles serving as spacer particles are dispersed on the electrodes.

Chiral nematic liquid crystal material that exhibits a cholesteric phase at room temperature is used as the liquid crystal 1016. Chiral nematic liquid crystal material is obtained by adding a chiral agent to nematic liquid crystal composition or compound. When added to nematic liquid crystal composition or compound, a chiral agent has the effect of twisting the molecular alignment of the nematic liquid crystal composition or compound, and the selective reflection wavelength of the liquid crystal material is controlled by adjusting the amount of chiral agent added.

In this liquid crystal display 1010, the transparent electrodes 1013 and 1014 of each display layer 1011B, 1011G and 1011R are connected to the drive circuits 1103, 1104 and 1105, respectively, such that a prescribed pulse voltage is applied between the transparent electrodes 1013 and 1014. In response to this applied voltage, the display of the liquid crystal 1016 is alternated between a transparent state (focal conic state) in which visible light passes through and a selective reflection state (planar state) in which visible light is selectively reflected.

The transparent electrodes 1013 and 1014 each comprise multiple parallel belt-shaped electrodes with a minute gap in between them, and the direction of alignment of the electrodes 1013 is perpendicular to the direction of alignment of the electrodes 1014, while they are made to face each other. In other words, display is performed through the serial application of voltage to each liquid crystal 1016 in a matrix fashion. By carrying out this matrix driving serially or simultaneously for each color display layer 1011B, 1011G and 1011R, multi-color images are displayed on the liquid crystal display 1010.

When a light-absorbing layer 1019 is placed on the bottommost layer, i.e, the layer farthest from the observer (the direction of arrow A), the light passing through each display layer 1011B, 1011G and 1011R is completely absorbed by the light-absorbing layer 1019. In other words, if all of the display layers are in the transparent state, black is displayed.

In the liquid crystal layers 1011B, 1011G and 1011R using chiral nematic liquid crystal material, where the selective reflection wavelength of the liquid crystal is in the visible light range, when the liquid crystal molecules have a focal conic alignment in which their helical axes are basically parallel to the substrate surface, although there is slight scattering of the incident visible light, the liquid crystal is essentially in a transparent state in which nearly all of the light passes through. Conversely, when the liquid crystal molecules have a planar alignment in which their helical axes are basically perpendicular to the substrate surface, the incident visible light having a wavelength corresponding to the helical pitch is selectively reflected. These two states can be alternated through the application of a prescribed voltage, and the state is maintained even when the application of voltage is stopped. In other words, the liquid crystal layers have a memory capability.

By setting the blue display layer 1011B and the green display layer 1011G of the liquid crystal display 1010 having the construction described above to be in a transparent state in which the liquid crystal molecules have a focal conic alignment, while setting the red display layer 1011R to a selective reflection state in which the liquid crystal molecules have a planar alignment, red display may be performed. By setting the blue display layer 1011B to be in a transparent state in which the liquid crystal molecules have a focal conic alignment, while setting the green display layer 1011G and the red display layer 1011R to a selective reflection state in which the liquid crystal molecules have a planar alignment, yellow display may be performed. Similarly, by appropriately setting each display layer to be in either a transparent state or a selective reflection state, red, green, blue, white, cyan, magenta, yellow or black display may be performed, and by setting each display layer to be in an intermediate selective reflection state, halftone colors can be displayed, enabling the liquid crystal display to be used as a multi-color display.

Figure 14:
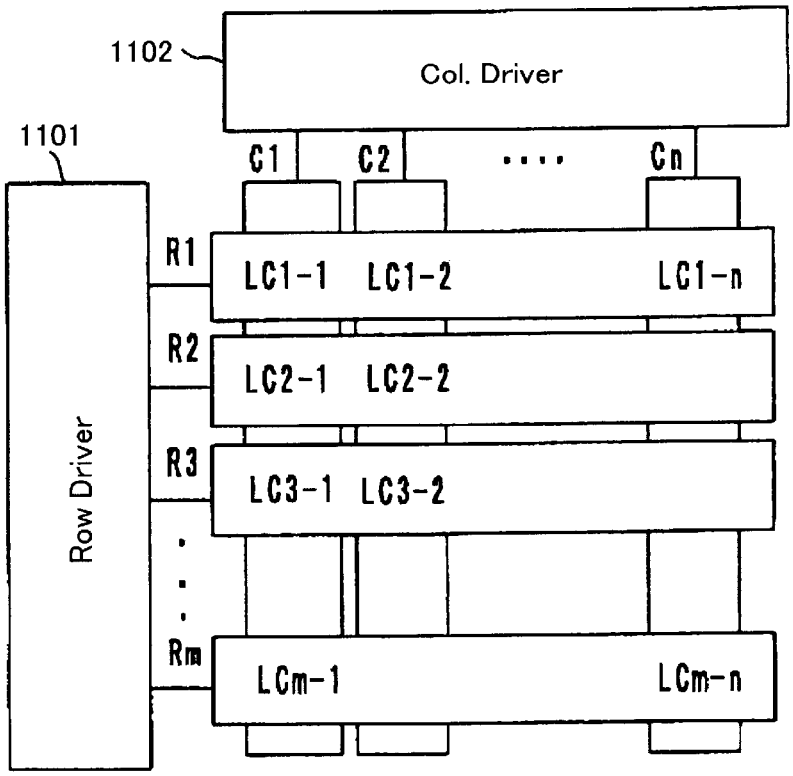
FIG. 14 is a block diagram showing the matrix drive circuit of the display described above.

Incidentally, because the pixels in each layer of the liquid crystal display 1010 have a simple matrix structure, it can be expressed as an (m×n) matrix incorporating the scanning electrodes R1, R2 . . . Rm and the signal electrodes C1, C2 . . . Cn, as shown in FIG. 14. The pixel at which a scanning electrode Ra and a signal electrode Cb intersect (where (a) and (b) satisfy the conditions a<m and b<n, respectively) are deemed Lca-b. These groups of electrodes are connected to the output terminals of the row driver 1101 and the column driver 1102, and a scanning voltage and selection voltage are applied to each electrode from the row driver 1101 and the column driver 1102. Incidentally, the applied voltages explained below (reset pulse signal, selection pulse signal) refer to the voltage level comprising the scanning voltage superimposed on the selection voltage.

(Driving Method)

The method for driving each liquid crystal display layer in the liquid crystal display 1010 will be explained using the example of the driving method in which each liquid crystal is reset to the focal conic state.

Figure 15:
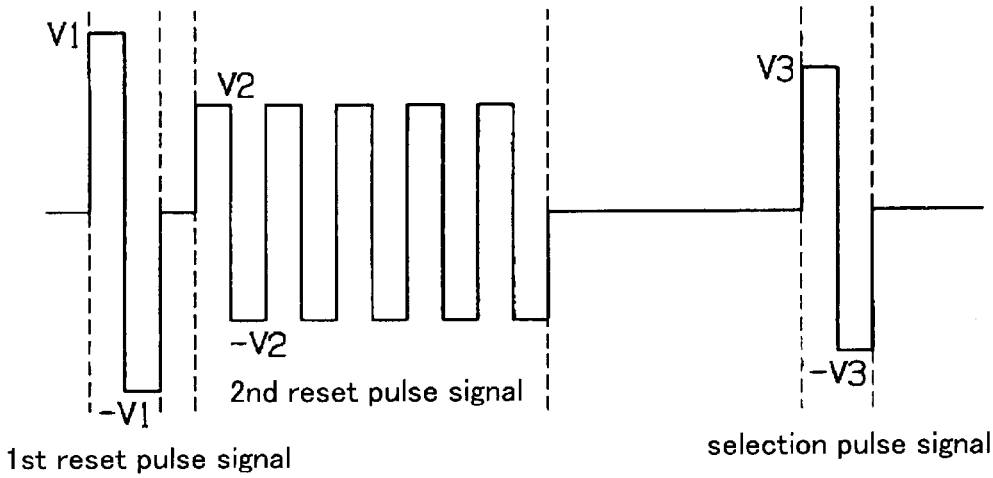
FIG. 15 is a chart showing the waveform of the drive pulse voltage.

FIG. 15 shows the waveform of the voltage applied to the liquid crystal layer when the liquid crystal material is reset to the focal conic state and the desired display is performed. FIG. 15 shows an ondogram of the drive voltage waveform. First, a first reset pulse signal having a voltage level V1 is applied. The twist structure of the chiral nematic liquid crystal material is cleared through the application of this pulse signal, and the liquid crystal material enters a homeotropic state. A second reset pulse signal having a voltage level V2 is then applied. This pulse signal changes the chiral nematic liquid crystal material to a focal conic state.

If the reset periods for the application of the first and second reset pulse signals are set simultaneously for all pixels, and the selection pulse signal is applied sequentially to the pixels in each scanning line to redraw the screen, a good screen display that does not exhibit the hysterisis phenomenon may be attained in a short amount of time.

A selection pulse signal is then applied to the pixels that are to perform display. The display state of the chiral nematic liquid crystal is determined based on the voltage level and pulse width of this pulse signal. Here, a voltage V3 comprising the minimum voltage necessary to set the chiral nematic liquid crystal to a planar state (the brightest state) is used.

(Y-V Characteristic of the Liquid Crystal)

Figure 20:
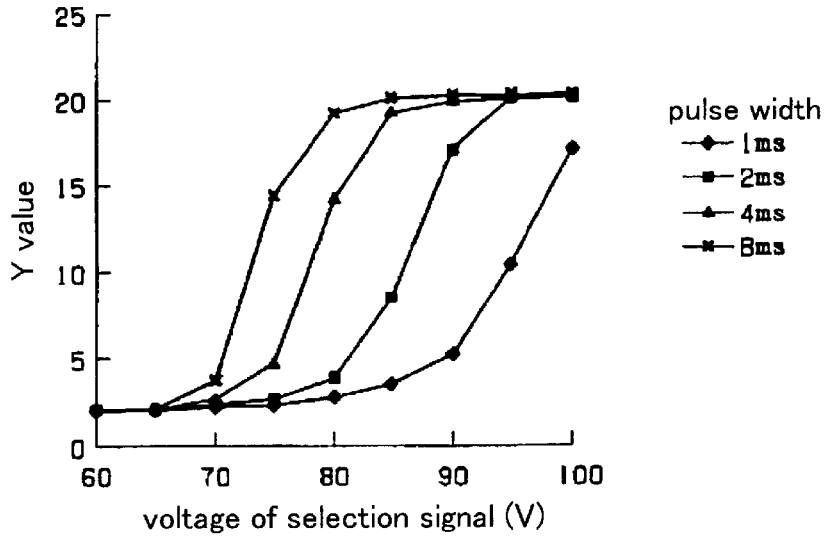
FIG. 20 is a graph showing the Y-V characteristic of the liquid crystal using the pulse width as a parameter.

An example in which the Y-V characteristic that describes the relationship between the voltage level V of the selection pulse signal and the selected Y value (luminous reflectance) in the display layer using chiral nematic liquid crystal material was measured for various pulse widths is shown in FIG. 20. In FIG. 20, the horizontal axis represents the voltage level of the selection pulse signal, while the vertical axis represents the selected Y value. By maintaining at a constant level the pulse width, which serves as a parameter, the orientation of the liquid crystal may be selected by adjusting the voltage level.

However, the Y-V characteristic changes in accordance with the pulse width of the selection pulse signal. In other words, as the pulse width increases, the voltage level needed to select the same Y value decreases. Conversely, as the pulse width decreases, the voltage level needed to select the same Y value increases. From this it is seen that the voltage level of the selection pulse signal is a function of the pulse width, and that the orientation of the liquid crystal is determined by the voltage level and the pulse width of the selection pulse signal.

Figure 21:
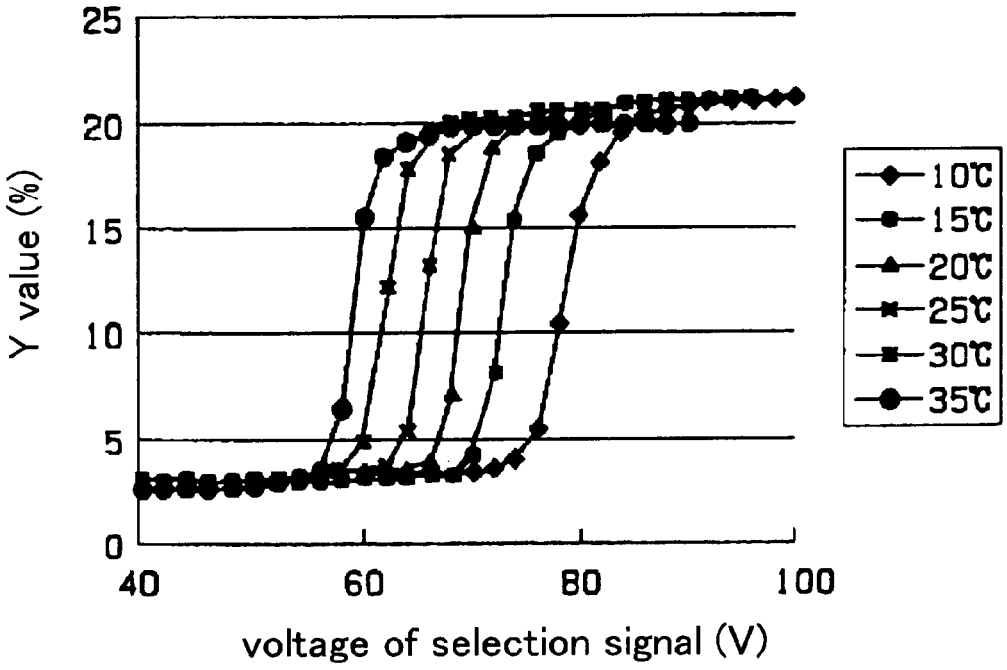
FIG. 21 is a graph showing the Y-V characteristic of the liquid crystal using the temperature as a parameter.

In addition, the Y-V characteristic of chiral nematic liquid crystal material changes in accordance with the temperature, and an example of this characteristic when the temperature is made a parameter is shown in FIG. 21. In FIG. 21, the horizontal axis represents the voltage level of the selection pulse signal, the vertical axis represents the selected Y value, and the pulse width is 4 ms for all temperatures.

As is clear from the example shown in FIG. 21, the necessary voltage to select a Y value of 15, for example, is 80V at 10° C., 70V at 20° C., and 63V at 30° C. This shows that as the ambient temperature rises, the voltage level of the selection pulse signal tends to fall. This phenomenon is thought to be due to the fact that the viscosity of chiral nematic liquid crystal falls as the temperature rises.

Consequently, in this embodiment, in order to compensate for this temperature characteristic of the liquid crystal, the temperature surrounding the liquid crystal display is detected, and temperature compensation is performed by adjusting the selection pulse signal in accordance with the detected temperature. This adjustment is performed to the voltage level and/or the pulse width.

In this embodiment, independent temperature compensation data is used for each of the three display layers 1101, 1102 and 1103.

Figure 16:
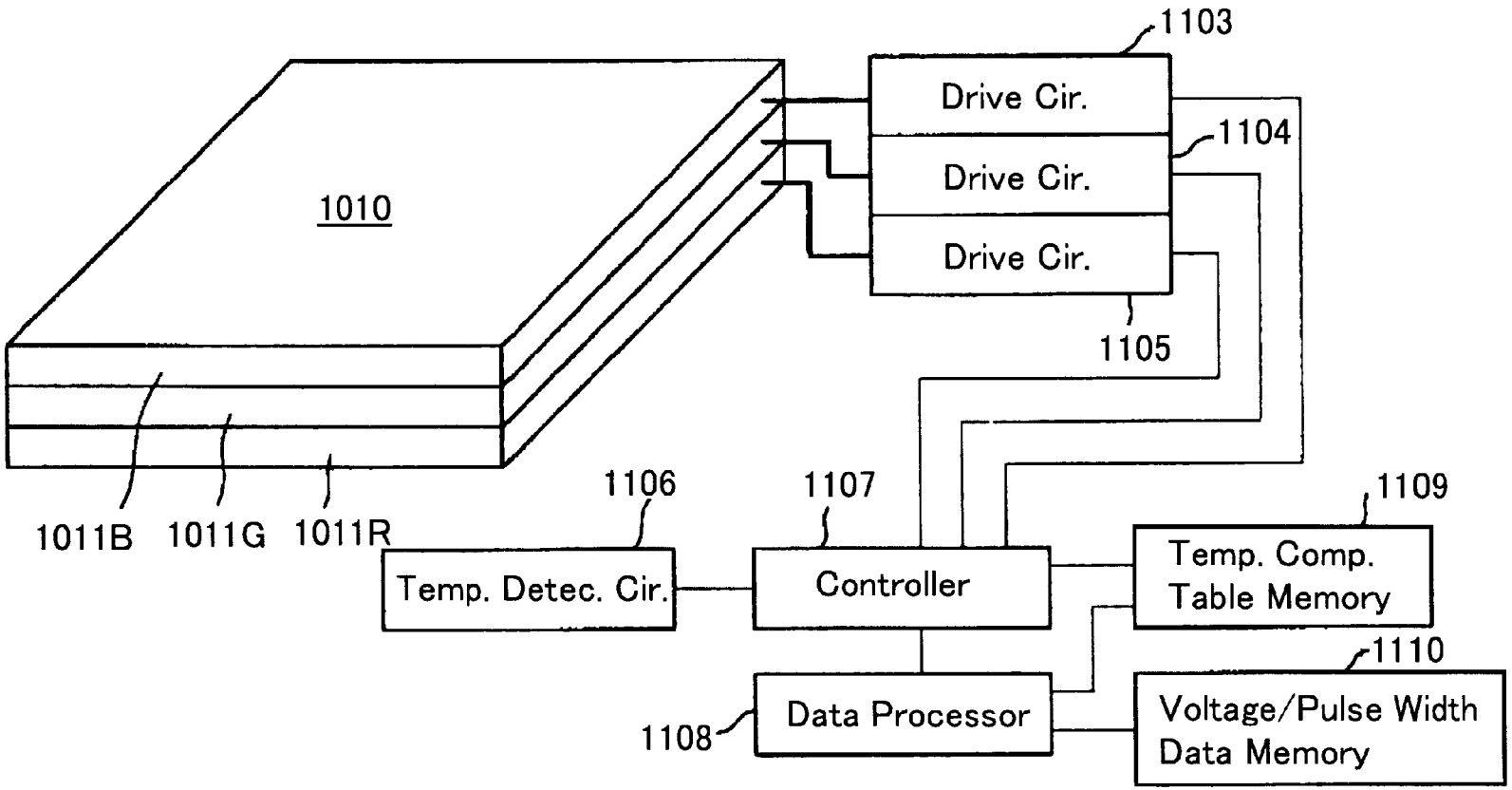
FIG. 16 is a block diagram showing the liquid crystal display apparatus of the sixth embodiment.

In FIG. 16, the liquid crystal display 1010 is the same as that shown in FIG. 13, and the drive circuits 1103, 1104 and 1105 used to drive the display layers 1011B, 1011G and 1011R, respectively, are controlled by a controller 1107. A temperature detection circuit 1106, data processor 1108 and temperature compensation table memory 1109 are connected to the controller 1107. In addition to the temperature compensation table memory 1109, a voltage/pulse width data memory 1110 is connected to the data processor 1108.

Figure 17:
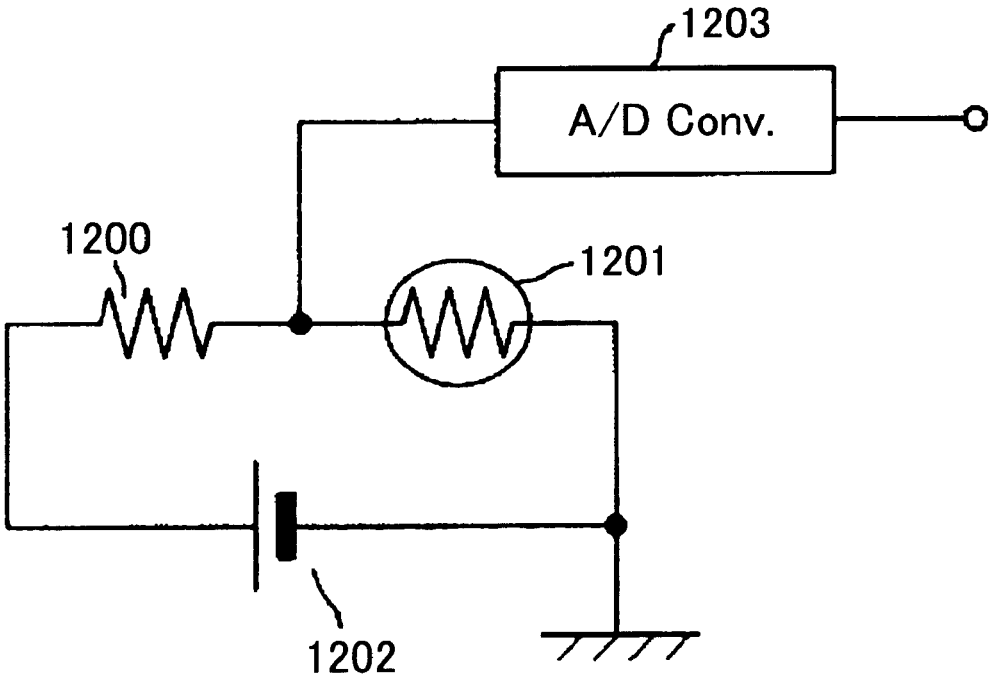
FIG. 17 is a block diagram showing a temperature detection circuit.

The temperature detection circuit 1106 detects the ambient temperature surrounding the liquid crystal display 1010, and as shown in FIG. 17, it comprises a resistor 1200, a thermistor 1201, a power supply 1202 and an A/D converter 1203. The voltage level input to the A/D converter 1203 changes due to the fact that the resistance of the thermistor 1201 changes in accordance with the temperature. This input value undergoes A/D conversion and is sent to the controller 1107 as temperature data.

The contents of the temperature compensation table memory 1109 are shown in Table 1 below.

TABLE 1

| Address | 32-bit data |
|---|---|
| 0000 | Optimal row voltage correction data for display layer 1011B at 5° C. |
| 0001 | Optimal row voltage correction data for display layer 1011G at 5° C. |
| 0002 | Optimal row voltage correction data for display layer 1011R at 5° C. |
| 0003 | Optimal column voltage correction data for display layer 1011B at 5° C. |
| 0004 | Optimal column voltage correction data for display layer 1011G at 5° C. |
| 0005 | Optimal column voltage correction data for display layer 1011R at 5° C. |
| 0006 | Optimal pulse width correction data for display layer 1011B at 5° C. |
| 0007 | Optimal pulse width correction data for display layer 1011G at 5° C. |
| 0008 | Optimal pulse width correction data for display layer 1011R at 5° C. |
| 0009 | Optimal row voltage correction data for display layer 1011B at 10° C. |
| 0010 | Optimal row voltage correction data for display layer 1011G at 10° C. |
| 0011 | Optimal row voltage correction data for display layer 1011R at 10° C. |
| 0012 | Optimal column voltage correction data for display layer 1011B at 10° C. |
| 0013 | Optimal column voltage correction data for display layer 1011G at 10° C. |
| 0014 | Optimal column voltage correction data for display layer 1011R at 10° C. |
| 0015 | Optimal pulse width correction data for display layer 1011B at 10° C. |
| 0016 | Optimal pulse width correction data for display layer 1011G at 10° C. |
| 0017 | Optimal pulse width correction data for display layer 1011R at 10° C. |
| . . . | . . . |
| 0054 | Optimal row voltage correction data for display layer 1011B at 35° C. |
| 0055 | Optimal row voltage correction data for display layer 1011G at 35° C. |
| 0056 | Optimal row voltage correction data for display layer 1011R at 35° C. |
| 0057 | Optimal column voltage correction data for display layer 1011B at 35° C. |
| 0058 | Optimal column voltage correction data for display layer 1011G at 35° C. |
| 0059 | Optimal column voltage correction data for display layer 1011R at 35° C. |
| 0060 | Optimal pulse width correction data for display layer 1011B at 35° C. |
| 0061 | Optimal pulse width correction data for display layer 1011G at 35° C. |
| 0062 | Optimal pulse width correction data for display layer 1011R at 35° C. |

The data in the memory 1109 is 32-bit data for each address, and comprises blocks of data for each temperature, where one block of data comprises row voltage level correction data, column voltage level correction data and pulse width correction data for the display layer 1011B at a given temperature, row voltage level correction data, column voltage level correction data and pulse width correction data for the display layer 1011G at a given temperature, and row voltage level correction data, column voltage level correction data and pulse width correction data for the display layer 1011R at a given temperature.

The voltage/pulse width data memory 1110 stores row voltage, column voltage and pulse width data for each display layer 1011B, 1011G and 1011R at a reference temperature, such as 25° C.

When an instruction to display an image is issued, the controller 1107 receives temperature data from the temperature detection circuit 1106, and reads the row voltage correction data, column voltage correction data and pulse width correction data for each display layer 1011B, 1011G and 1011R written in the prescribed addresses in the temperature compensation table memory 1109 based on this temperature data. The read data is integrated by the data processor 1108 with the row voltage data, column voltage data and pulse width correction data for each display layer 1011B, 1011G and 1011R stored in the voltage/pulse width data memory 1110, and they are corrected to the row voltage data, column voltage data and pulse width correction data for the detected temperature. The controller 1107 receives this corrected data, and performs control so that the drive circuits 1103, 1104 and 1105 issue selection pulse signals having independent voltage levels and pulse widths.

Seventh Embodiment

If the temperature coefficients for the display layers 1011B, 1011G and 1011R are set to be identical, the same row voltage, column voltage and pulse width temperature compensation data can be used for each layer 1011B, 1011G and 1011R. This seventh embodiment uses common temperature compensation data for each of the three display layers 1011B, 1011G and 1011R.

The construction of the apparatus in the seventh embodiment is identical to that of the apparatus shown in FIG. 16 with regard to the sixth embodiment. However, the contents of the temperature compensation table memory 1109 are simplified, as shown in Table 2 below.

TABLE 2

| Address | 32-bit data |
|---|---|
| 0000 | Optimal row voltage correction data at 5° C. |
| 0001 | Optimal column voltage correction data at 5° C. |
| 0002 | Optimal pulse width correction data at 5° C. |
| 0003 | Optimal row voltage correction data at 10° C. |
| 0004 | Optimal column voltage correction data at 10° C. |
| 0005 | Optimal pulse width correction data at 10° C. |
| . . . | . . . |
| 0021 | Optimal row voltage correction data at 35° C. |
| 0022 | Optimal column voltage correction data at 35° C. |
| 0023 | Optimal pulse width correction data at 35° C. |

The row voltage correction data, column voltage correction data and pulse width correction data for each temperature are written in the memory 1109. In addition, the voltage/pulse width data memory 1110 stores row voltage, column voltage and pulse width data for each display layer 1011B, 1011G and 1011R at a reference temperature such as 25° C., as in the sixth embodiment.

When an instruction to display an image is issued, the controller 1107 receives temperature data from the temperature detection circuit 1106, and reads the row voltage correction data, column voltage correction data and pulse width correction data written in the prescribed addresses in the temperature compensation table memory 1109 based on this temperature data. The read data is integrated by the data processor 1108 with the row voltage data, column voltage data and pulse width correction data for each display layer 1011B, 1011G and 1011R stored in the voltage/pulse width data memory 1110, and they are corrected to the row voltage data, column voltage data and pulse width correction data for the detected temperature. The controller 1107 receives this corrected data, and performs control so that the drive circuits 1103, 1104 and 1105 issue selection pulse signals having independent voltage levels and pulse widths.

It is also acceptable if (i) revised data and a revision formula to revise the correction data used to perform temperature compensation are used for each liquid crystal display layer, (ii) the correction data is revised for each liquid crystal display layer, and (iii) temperature compensation is performed for each liquid crystal display layer as in the example of the sixth embodiment.

It is furthermore acceptable if correction is performed only for those liquid crystal display layers for which temperature compensation must be performed.

Eighth Embodiment

Figure 18:
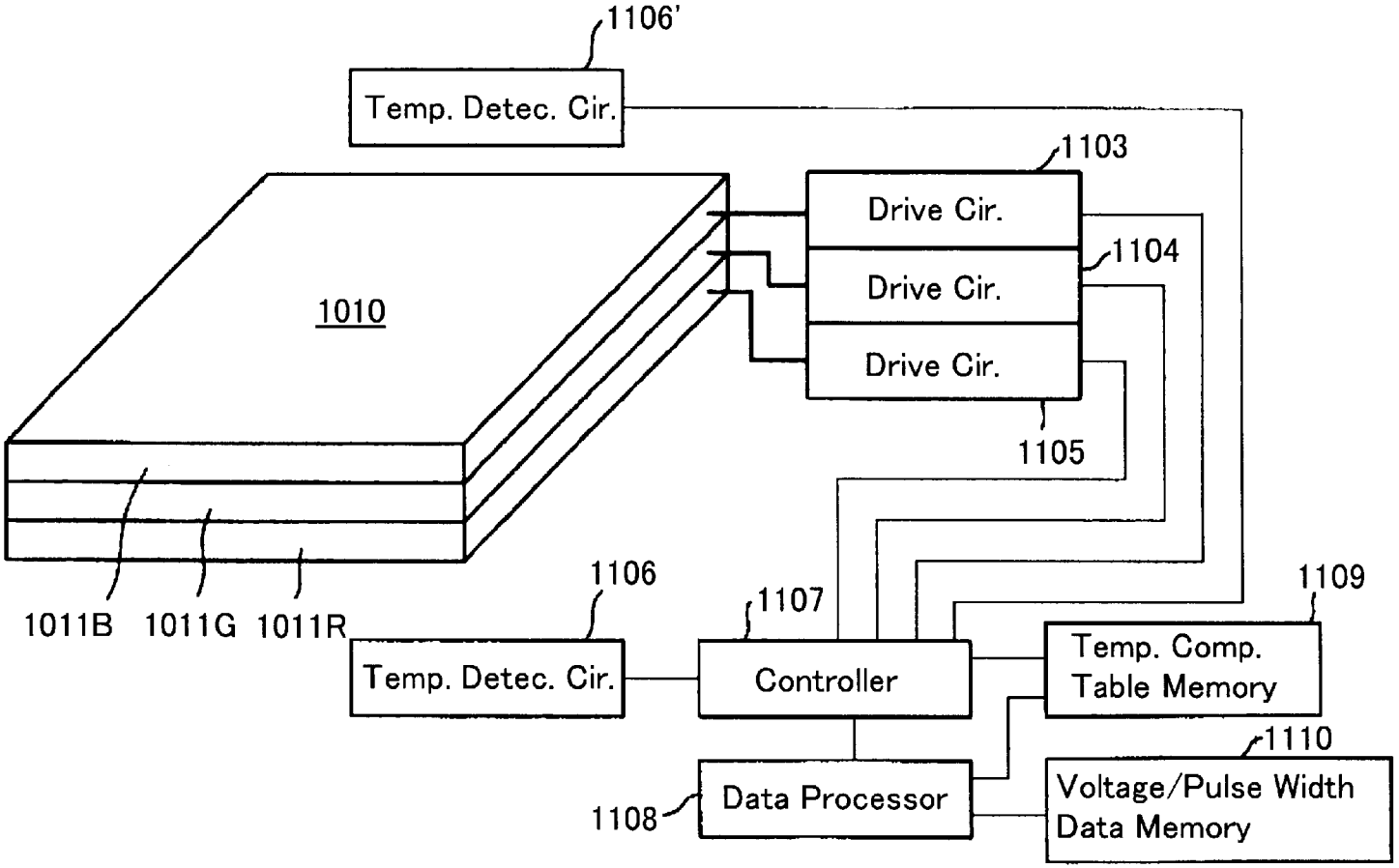
FIG. 18 is a block diagram showing the liquid crystal display apparatus of a seventh embodiment.

In this eighth embodiment, as shown in FIG. 18, two temperature detection circuits 1106 and 1106' are located on the observation side and the back side of the liquid crystal display 1010, respectively, the temperature information from each circuit and the difference in their detected temperatures is detected, and the results are reflected in the temperature compensation performed for each liquid crystal display layer 1011B, 1011G and 1011R. One form of temperature compensation in this instance involves a method in which the method of performing temperature compensation for the liquid crystal display layer 1011B located at the observation side of the liquid crystal display is made different from the method of performing temperature compensation for the liquid crystal display layer 1011R located at the back of the liquid crystal display. Regarding the middle liquid crystal display layer 1011G, temperature compensation based on an inferred value derived from the temperature gradient between the temperature detection circuit 1106' located at the observation side of the liquid crystal display and the temperature detection circuit 1106 located at the back of the liquid crystal display. In either case, by incorporating temperature information from both the observation side and the back of the liquid crystal display through the use of multiple temperature detection circuits, more precise temperature compensation can be performed.

Ninth Embodiment

Figure 19:
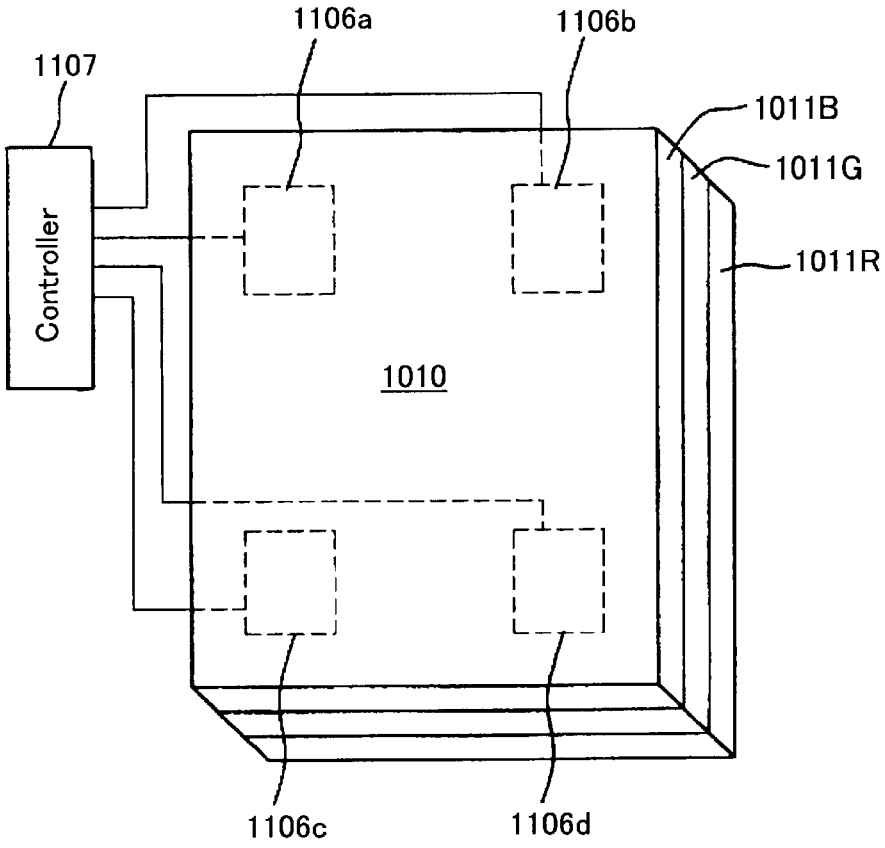
FIG. 19 is a perspective view of a liquid crystal display apparatus of an eighth embodiment.

In the ninth embodiment, as shown in FIG. 19, the temperature at multiple locations is measured by temperature detection circuits 1106*a* through 1106*d* located on the same plane as the surface of the liquid crystal display 1010, and the detected temperatures are reflected in the ensuing temperature compensation. In this case, temperature compensation can be performed while taking into account (through averaging, for example) temperature data for each location, for example. Temperature compensation can also be performed by adjusting the voltage waveform for each area in accordance with the temperature data for each location. This method is particularly useful when the screen size of the liquid crystal display 1010 is large.

Other Embodiments

The liquid crystal display apparatus pertaining to the present invention is not limited to the embodiments described above, and may be changed in various ways within its essential scope. In particular, the constructions of the liquid crystal display and of the drive and temperature detection circuits may be freely changed.

In the sixth and seventh embodiments, although the temperature compensation data are stored in a form of a table, the data may be stored in a form of formulas representing the temperature characteristics of the liquid crystal layers.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A liquid crystal display apparatus comprising:

a liquid crystal display including a liquid crystal material having a memory capability;

a temperature detection unit that detects a temperature of the liquid crystal display or a temperature of an environment surrounding the liquid crystal display; and a control unit connected with the liquid crystal display and the temperature detection unit, the control unit, upon a reception of a display request, applying drive pulse signals to the liquid crystal display to draw a first image on the liquid crystal display and leaving the liquid crystal without applying a drive pulse signal to maintain the first image by using the memory capability of the liquid crystal, wherein the control unit incorporates temperature information from the temperature detection unit responsive to the display request before the drawing of the first image.

2. A liquid crystal display apparatus comprising:

a liquid crystal display including a liquid crystal material having a memory capability;

a temperature detection unit that detects a temperature of the liquid crystal display or a temperature of an environment surrounding the liquid crystal display; and a control unit connected with the liquid crystal display and the temperature detection unit, the control unit being operable in a first display mode and a second display mode, wherein, under the first display mode, the control unit applies drive pulse signals to the liquid crystal display to draw a first image on the liquid crystal display and leaving the liquid crystal without applying a drive pulse signal to maintain the image by using the memory capability of the liquid crystal, wherein, under the second display mode, the control unit applying drive pulse voltages to the liquid crystal display to successively draw a second image to an n-th image data on the liquid crystal display, and wherein the control unit, under either one of the first mode and the second mode, incorporates temperature information from the temperature detection unit before drawing commencement.

3. A liquid crystal display apparatus as claimed in claim 2, wherein, under the second display mode, the control unit does not incorporate temperature information from the temperature detection unit between the drawings of the second image to n-th image.

4. A liquid crystal display apparatus as claimed in claim 1, wherein the drive voltages are optimal voltages for the liquid crystal display at the temperature detected by the temperature detection unit.

5. A liquid crystal display apparatus as claimed in claim 1, wherein the liquid crystal material comprises a liquid crystal composition exhibiting a cholesteric phase.

6. A liquid crystal display apparatus as claimed in claim 4, wherein the liquid crystal material comprises a liquid crystal composition exhibiting a nematic phase and a chiral agent.

7. A liquid crystal display apparatus comprising:

a liquid crystal display including a liquid crystal material having a memory capability;

a temperature detection unit that detects a temperature of the liquid crystal display or a temperature of an environment surrounding the liquid crystal display; and a control unit connected with the liquid crystal display and the temperature detection unit, the control unit applying a first reset pulse signal to the liquid crystal display, the first reset pulse signal being for setting the liquid crystal to a homeotropic state before the liquid crystal is set to the desired selective reflection state, wherein the control unit keeps a voltage level and a pulse width of the first reset pulse signal constant regardless of the temperature detected by the temperature detection unit.

8. A liquid crystal display apparatus as claimed in claim 7, wherein the control unit applies selection pulse signals to the liquid crystal display to set an area of the liquid crystal display to a desired state to display an image on the liquid crystal display.

9. A liquid crystal display apparatus as claimed in claim 8, wherein the control unit controls at least one of a voltage level and a pulse width of the selection pulse signals in accordance with the detected temperature.

10. A liquid crystal display apparatus as claimed in claim 8, wherein the control unit applies a second reset pulse signal between the applications of the first reset pulse signal and the selection pulse signal, the second reset pulse voltage being for setting the liquid crystal material to a focal conic state.

11. A liquid crystal display apparatus as claimed in claim 10, wherein at least either a voltage level and a pulse width of the second reset pulse signal is controlled by the control unit in accordance with the detected temperature.

12. A liquid crystal display apparatus as claimed in claim 10, wherein both of a voltage level and a pulse width of the second reset pulse signal are kept constant regardless of the detected temperature.

13. A liquid crystal display apparatus as claimed in claim 7, wherein the liquid crystal material comprises a liquid crystal composition exhibiting a cholesteric phase.

14. A liquid crystal display apparatus as claimed in claim 13, wherein the liquid crystal material comprises a liquid crystal composition exhibiting a nematic phase and a chiral agent.

15. A liquid crystal display apparatus comprising:

a liquid crystal display comprising a plurality of liquid crystal display layers stacked on each other;

a drive unit connected with the liquid crystal display, the drive unit applying a pulse signal to each of the liquid crystal display layers to drive the liquid crystal display layers;

a temperature detection unit that detects a temperature of the liquid crystal display or a temperature of an environment surrounding the liquid crystal display; and a controller connected with the drive unit and the temperature detection unit, the controller performs a temperature compensation by adjusting at least one of a voltage level and a pulse width of the pulse signal applied from the drive unit to at least one of the liquid crystal display layers based on the temperature detected by the temperature detection unit in response to a display request before drawing of a first image, wherein the controller includes a memory storing temperature compensation data common to all the liquid crystal display layers, and wherein the controller performs the temperature compensation by referring to the temperature compensation data stored in the memory.

16. A liquid crystal display apparatus as claimed in claim 15, wherein the controller performs the temperature compensation for all of the liquid crystal display layers.

17. A liquid crystal display apparatus comprising:

a liquid crystal display comprising a plurality of liquid crystal display layers stacked on each other;

a drive unit connected with the liquid crystal display, the drive unit applying a pulse signal to each of the liquid crystal display layers to drive the liquid crystal display layers;

a temperature detection unit that detects a temperature of the liquid crystal display or a temperature of an environment surrounding the liquid crystal display; and a controller connected with the drive unit and the temperature detection unit, the controller performs a temperature compensation by adjusting at least one of a voltage level and a pulse width of the pulse signal applied from the drive unit to at least one of the liquid crystal display layers based on the temperature detected by the temperature detection unit in response to a display request before drawing of a first image, wherein the controller comprises a memory storing temperature compensation data including a plurality of sets of data respectively corresponding to the liquid crystal display layers, and wherein the controller performs the temperature compensation by referring to the temperature compensation data stored in the memory.

18. A liquid crystal display apparatus as claimed in claim 15, wherein each of the liquid crystal display layers comprises a liquid crystal composition exhibiting a cholesteric phase.

19. A liquid crystal display apparatus as claimed in claim 18, wherein each of the liquid crystal display layers comprises a liquid crystal composition exhibiting a nematic phase and a chiral agent.

20. A liquid crystal display apparatus comprising:

a liquid crystal display including a plurality of portions;

a drive unit for driving the plurality of portions of the liquid crystal display;

a plurality of temperature detecting sensors provided for the respective plurality of portions;

a controller, connected with the drive unit and the temperature sensors, for receiving signals regarding temperatures from the temperature sensors and for controlling the drive unit so that each of the plurality of portions is subjected to temperature compensations based on the signals received from a respective one of the temperature detecting sensors in response to a display request before drawing of a first image.

21. A liquid crystal display apparatus as claimed in claim 20, wherein the liquid crystal display has a surface on which the portions are defined.

22. A liquid crystal display apparatus as claimed in claim 20, wherein the liquid crystal display comprises a plurality of liquid crystal display layers of which a most upper one and a most lower one correspond to the portions.

23. A liquid crystal display apparatus as claimed in claim 1, wherein the control unit includes a table of temperature compensation.

24. A liquid crystal display apparatus as claimed in claim 23, wherein the control unit compensates a reference value based on compensation data from the table of temperature compensation.

25. A liquid crystal display apparatus as claimed in claim 23, wherein the table of temperature compensation includes data for compensating at least one of voltage value and pulse width.

26. A liquid crystal display apparatus as claimed in claim 25, wherein the data includes row voltage value or pulse width compensation data.

27. A liquid crystal display apparatus as claimed in claim 25, wherein the data includes column voltage value or pulse width compensation data.

* * * * *